United States Patent [19]

Luursema

[11] Patent Number: 4,645,976

[45] Date of Patent: Feb. 24, 1987

[54] DISCHARGE LAMP CIRCUIT WITH PROTECTED PTC RESISTOR

[75] Inventor: Meerten Luursema, Eindhoven, Netherlands

[73] Assignee: U.S. Philips Corporation, New York, N.Y.

[21] Appl. No.: 856,846

[22] Filed: Apr. 21, 1986

Related U.S. Application Data

[63] Continuation of Ser. No. 679,175, Dec. 7, 1984, abandoned.

[30] Foreign Application Priority Data

Dec. 16, 1983 [NL] Netherlands ..... 8304333

[51] Int. Cl.[4] ..... H05B 37/02

[52] U.S. Cl. ..... 315/106; 315/100; 315/102; 315/309

[58] Field of Search ..... 315/106, 100, 102, 309

[56] References Cited

U.S. PATENT DOCUMENTS

| | | | |
|---|---|---|---|
| 2,268,512 | 12/1941 | McCarthy | 315/102 |
| 2,299,499 | 10/1942 | Sanford | 315/100 |
| 2,476,330 | 7/1949 | Sitzer | 315/100 |
| 2,849,656 | 8/1958 | Karash | 315/100 |
| 2,935,659 | 5/1960 | Zangerle | 315/100 |
| 3,097,325 | 7/1963 | Cosnuau | 315/100 |
| 3,975,660 | 8/1976 | Knobel et al. | 315/102 |
| 4,017,761 | 4/1977 | Woldring | 315/106 |

*Primary Examiner*—Harold Dixon

*Attorney, Agent, or Firm*—Robert T. Mayer; Bernard Franzblau

[57] ABSTRACT

An electrical device for igniting and supplying a low-pressure mercury vapor discharge lamp (11) provided with two preheatable electrodes (12,13). A series arrangement (12, 4, 14, 13) comprising the two lamp electrodes (12, 13), a PTC resistor (14) and a second winding (4) of a transformer fed back negatively with respect to a first winding (3) thereof is connected to a connection point of the first transforming winding. This series arrangement (12, 4, 14, 13) is further connected to a second connection point of the first transformer winding (3). Thus, the electrical device will readily ignite and supply the lamp and will also protect the PTC resistor of the electrical device should the lamp fail to ignite even with lamp electrodes that are uninterrupted.

10 Claims, 1 Drawing Figure

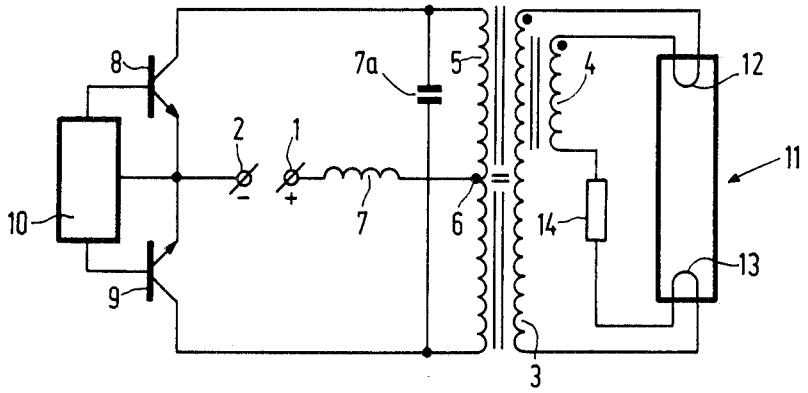
8
7a
5
4
12
2
1
11
10
7
6
14
13
9
3

DISCHARGE LAMP CIRCUIT WITH PROTECTED PTC RESISTOR

This a continuation of application Ser. No. 679,175, filed Dec. 7, 1984 now abandoned.

This invention relates to an electrical device for igniting and supplying a gas and/or vapour discharge lamp provided with at least two preheatable electrodes. More particularly to such a device comprising a transformer with at least two windings and supplied with electric energy via the first winding, while in the operating condition a series arrangement is connected to a first connection point of the first winding. This series arrangement comprises at least the first electrode of the lamp, the second winding of the transformer, a resistor having a positive temperature coefficient and the second electrode, the second winding of the transformer being fed back negatively with respect to the first winding and being situated together with the resistor having a positive temperature coefficient in that part of the series arrangement between the lamp electrodes.

The statement that the second winding of the transformer is fed back negatively with respect to the first winding of the transformer means that the second transformer winding is so connected that the voltage across it leads to a decrease of the voltage across the resistor having a positive temperature coefficient (PTC resistor).

A known electrical device of the kind mentioned is described, for example, in the German "Auslegeschrift" No. 1,914,211. In this known device, the resistor having a positive temperature coefficient (PTC resistor) will have, during the process of igniting the lamp, initially a low temperature and will consequently be low-ohmic. As a result, the electrodes of the lamp can then be preheated via the said series arrangement. In the operating condition of the lamp, the PTC resistor will have a higher temperature and will consequently be in its high-ohmic range.

A disadvantage of the said known device, however, is that the voltage across the PTC resistor may be comparatively large in a situation in which the lamp fails to ignite even though its electrodes are uninterrupted. This situation is sometimes designated as: de-activated lamp.

A de-activated lamp is obtained, for example, if the electrodes, after many operating hours of the lamp, are no longer provided with emitter material.

The indicated comparatively large voltage across the PTC resistor can in fact cause the PTC resistor to become unusable so that the known electrical device can then no longer even ignite a new lamp which replaces the deactivated lamp.

An object of the invention is to provide an electrical device of the kind mentioned in which, on the one hand, in the case of ignition of a serviceable lamp, the situation in which the electrodes can be readily preheated is maintained, while on the other hand, in the case of a de-activated lamp, the voltage across the PTC resistor is kept comparatively low.

According to the invention an electrical device for igniting and supplying a gas and/or vapour discharge lamp is provided with at least two preheatable electrodes comprises a transformer with at least two windings and is supplied via the first winding. In the operating condition a series arrangement is connected to a first connection point of the first winding. This series arrangement at least comprises the first electrode of the lamp, the second winding of the transformer, a resistor having a positive temperature coefficient and the second electrode. The second winding of the transformer is fed back negatively with respect to the first winding and is situated, together with the resistor having a positive temperature coefficient, in that part of the series arrangement between the lamp electrodes. The invention is characterised in that a second connection point of the first winding of the transformer is connected to the other end of the series arrangement.

An advantage of this electrical device is that, in the case, for example, of the lamp becoming a deactivated lamp, only a comparatively small voltage is applied across the PTC resistor. As a result, the risk of this PTC resistor becoming defective is small. A serivceable lamp can still readily ignite with the use of this elelctrical device.

The invention is based on the idea that the first transformer winding is included in the circuit in a manner such that the influence of the transformer on the decrease of the voltage across the PTC resistor is maintained at small values of the current through the first transformer winding and the series arrangement of inter alia the second transformer winding and the PTC resistor.

The following explanation is given. In the case of a de-activated lamp for example, the PTC resistor of the electrical device is mostly in the high-ohmic state. This means that the current strength in the aforementioned first transformer winding and the series arrangement is only comparatively small. In a device according to the invention, the voltage across the PTC resistor is then approximately equal to the voltage difference across the first and the second transformer windings. The influence of the transformer on the voltage across the PTC resistor in a device according to the invention is therefore maintained because, even with this small current strength, the voltage across the first transformer winding is comparatively large. This is not the case in the above-mentioned known device. In that known device the voltage across the PTC resistor, in the case of a de-activated lamp, will in fact be determined to a greater extent by the comparatively large voltage between the AC supply terminals.

The aforementioned difference is due to the manner in which the series arrangement is connected to the first transformer winding.

In a preferred embodiment of an electrical device according to the invention, the first winding of the transformer is further coupled with a certain amount of leakage to a third winding of the transformer, at least two connection terminals of the third winding being intended to be connected to an electrical supply source.

An advantage of this preferred embodiment is that, via the said leakage, the said transformer can also stabilize the current through the lamp in the operating condition of the lamp.

In a further preferred embodiment of an electrical device according to the invention, the ratio between the number of turns of the first winding of the transformer and that of the second winding of the transformer lies between 1.5 and 2.5.

An advantage of this preferred embodiment is that the lamp can start satisfactorily and that during the operating condition of the lamp, and even with a deactivated lamp, only a small voltage is applied across the resistor having a positive temperature coefficient. This means that the electrical device can be very reliable.

An embodiment of the invention will be described more fully with reference to the drawing.

The drawing shows an electrical circuit of a device according to the invention and a low-pressure mercury vapour discharge lamp connected thereto. The drawing further shows a direct current/alternating current push-pull converter which serves as the source of electricity.

In the drawing, reference numerals 1 and 2 designate input terminals intended to be connected to a direct voltage source of about 80 V.

Reference numeral 3 denotes a first winding of a transformer. This winding is tightly coupled to a second winding 4. The winding 3 is further coupled with a cerain amount of leakage to a third winding 5. The winding 5 is provided with a centre tapping 6 which is connected through an auxiliary coil 7 to the input terminal 1. An auxiliary capacitor *7a* shunts the third winding 5. One end of the third winding 5 is connected through an npn transistor 8 to the terminal 2. The other end of the third winding 5 is also connected through an npn transistor 9 to the terminal 2. A control circuit 10 (details not shown), connected to the bases and to the emitters of the transistors 8 and 9, ensures that the two transistors 8 and 9 are alternately rendered conducting.

A low-pressure mercury vapour discharge lamp 11 is provided with two preheatable electrodes 12 and 13. A series arrangement of the first electrode 12, the second winding 4 of the transformer, a resistor 14 having a positive temperature coefficient and the lamp electrode 13 is connected to a connection point of the first transformer winding 3. The other end of this series arrangement is connected to a second connection point of the first transformer winding. Voltages across the transformer windings 3 and 4 are in the same direction with respect to each other. This means that the voltage across the PTC resistor 14 is smaller than that between the electrodes 12 and 13 of the lamp.

The device described operates as follows. When the direct current/alternating current converter (1, 2, 5 to 10) has started, voltages are induced by the winding 5 in the first winding 3 of the transformer. As a result, a current starts to flow in the aforementioned series arrangement (12, 4, 14, 13). Since the PTC resistor 14 then has a comparatively low temperature, its ohmic resistance is small. The preheating current through this series arrangement and consequently through the two electrodes (12 and 13) is therefore comparatively large. This current, which also flows through the PTC resistor 14, causes this resistor to assume a higher temperature. As a result, the PTC resistor 14 reaches its high-ohmic range. This results in a voltage being applied between the electrodes 12 and 13 of the lamp 11 at which the lamp ignites.

The winding 4 fed back negatively ensures that in the now existing operating condition of the lamp 11 the voltage across the PTC resistor 14 is only small. Also in the case of a de-activated lamp, the voltage across the PTC resistor 14 is small.

In one embodiment, the electric circuit elements had approximately the following values:

coil 7: approximately 15 mH
capacitor *7a*: approximately 0.015 μF
number of turns of the winding 5: $2\times80=160$
number of turns of the winding 3: 380
number of turns of the winding 4: 190
ohmic value PTC resistor 14 at about 20° C.: 70Ω
switching temperature of PTC resistor 14 is about 115° C.

In this embodiment, the ohmic value of the PTC resistor 14 in the case of an ignited lamp and also in the case of a de-activated lamp exceeded 4 kΩ.

The lamp 11 was of the 13 W type with an operating voltage of about 85 V.

The input voltage between the terminals 1 and 2 was about 80 V.

During the starting process of the lamp, a voltage of 400 V was applied between the electrodes 12 and 13. The preheating current then amounted to about 0.3 A. The lamp then ignited within 2 seconds. In the operating condition of the lamp, a voltage of about 42 V was applied across the PTC resistor 14.

In the case of a de-activated lamp, the voltage across the PTC resistor 14 was only 200 V. This value is lower than the maximum permissible voltage, around 245 V, for this PTC resistor.

It appears from the foregoing that the device described, which may serve, for example, for the illumination in a vehicle, leads to a satisfactory ignition of the lamp. Moreover, this device is capable of withstanding the situation which arises in the case of a de-activated lamp.

What is claimed is:

1. An electrical device for igniting and supplying a gas and/or vapor discharge lamp provided with at least two preheatable electrodes comprising: a transformer with at least two windings, means for supplying electric energy to the transformer via a first winding, while in the operating condition one end of a series arrangement is connected to a first connection point of the first winding, said series arrangement at least comprising a first electrode of the lamp, a second winding of the transformer, a resistor having a positive temperature coefficient and a second lamp electrode, the second winding of the transformer being fed back negatively with respect to the first winding and being situated together with the resistor having a positive temperature coefficient in that part of the series arrangement between the lamp electrodes, and means connecting a second connection point of the first winding of the transformer to the other end of the series arrangement.

2. An electrical device as claimed in claim 1, characterised in that the first winding of the transformer is further coupled with a certain amount of leakage to a third winding of the transformer, and in that two connection terminals of the third winding are intended to be connected to an electrical supply source.

3. An electrical device as claimed in claim 1 wherein the ratio between the number of turns of the first winding of the transformer to that of the second winding of the transformer lies between 1.5 and 2.5.

4. An electrical device as claimed in claim 2 wherein the ratio between the number of turns of the first winding of the transformer to the number of turns of the second winding of the second transformer lies between 1.5 and 2.5.

5. Apparatus for igniting and operating a discharge lamp of the type having first and second preheatable electrodes comprising: a transformer having first and second windings, a pair of input terminals for connection to a source of AC electric energy, means for coupling said input terminals to said first winding of the transformer, means connecting the first lamp electrode, the second transformer winding, a PTC resistor and the second lamp electrode in a series circuit with one end of the series circuit connected to a first terminal of the first transformer winding such that the second transformer winding and the PTC resistor are in parallel with the lamp, and means connecting a second terminal of the first winding of the transformer to the other end of said series circuit, said first and second windings being wound such that voltages developed thereacross are in phase opposition in the operation of said apparatus.

6. Apparatus as claimed in claim 5 wherein said coupling means comprises a third winding of the transformer having first and second terminals connected to said first and second input terminals, respectively, said first and third windings being coupled together with a leakage inductance sufficient to provide stabilization of lamp current in the operating condition of the lamp.

7. Apparatus as claimed in claim 5 wherein the turns ratio of the first winding to the second winding of the transformer is in the range of 1.5 to 2.5.

8. Apparatus as claimed in claim 5 wherein said input terminals are coupled to a DC/AC converter comprising a pair of transistors coupled together in a push-pull circuit that is connected to terminals for a DC voltage source.

9. Apparatus as claimed in claim 8 wherein said coupling means comprises a third winding of the transformer having first and second terminals connected to said first and second input terminals, respectively, a capacitor coupled to the first and second terminals of the third winding to form a parallel LC circuit with the third winding that operates as a frequency determining mechanism for said DC/AC converter.

10. Apparatus as claimed in claim 5 wherein said first winding forms a closed loop circuit with said series circuit such that voltages developed across the first and second windings are in series opposition.

* * * * *